US007494410B2

(12) United States Patent
Romik

(10) Patent No.: US 7,494,410 B2
(45) Date of Patent: Feb. 24, 2009

(54) SYSTEM AND METHOD FOR SKILL BASED GAMES OF CHANCE

(75) Inventor: Pinhas Romik, Rehovot (IL)

(73) Assignee: Duplicate (2007) Inc., New York, NY (US)

( * ) Notice: Subject to any disclaimer, the term of this patent is extended or adjusted under 35 U.S.C. 154(b) by 365 days.

(21) Appl. No.: 11/184,900

(22) Filed: Jul. 20, 2005

(65) Prior Publication Data

US 2007/0037623 A1 Feb. 15, 2007

(51) Int. Cl.
*A63G 17/32* (2006.01)

(52) U.S. Cl. ..... 463/13; 463/12; 463/29

(58) Field of Classification Search ..... 463/11–13, 463/42

See application file for complete search history.

(56) References Cited

U.S. PATENT DOCUMENTS 5,544,892 A * 8/1996 Breeding ..... 273/292
5,857,911 A * 1/1999 Fioretti ..... 463/40
5,879,233 A * 3/1999 Stupero ..... 463/11
5,935,002 A * 8/1999 Falciglia ..... 463/19
6,012,984 A * 1/2000 Roseman ..... 463/42
6,174,237 B1 * 1/2001 Stephenson ..... 463/42
6,604,997 B2 * 8/2003 Saidakovsky et al. ..... 463/9
6,824,462 B2 * 11/2004 Lydon et al. ..... 463/9
7,104,542 B2 * 9/2006 Peterson ..... 273/274
2004/0132521 A1 7/2004 Peterson
2005/0116416 A1 * 6/2005 Peterson ..... 273/292

OTHER PUBLICATIONS

Laws of Duplicate Contract Bridge. The official Encyclopedia on Bridge, 5th edition, published by the ACBL, keyword "Laws of Duplicate Contract Bridge".

* cited by examiner

*Primary Examiner*—John M Hotaling, II
(74) *Attorney, Agent, or Firm*—Ked & Associates LLP

(57) ABSTRACT

A system and method for skilled-based games of chance where identical cards may be dealt to corresponding positions at different tables. The performance of play of players at corresponding positions at such tables may be compared.

32 Claims, 5 Drawing Sheets

| COL. 1 | COL. 2 | COL. 3 | COL. 4 | COL. 5 | COL. 6 | COL. 7 |
|---|---|---|---|---|---|---|
| HAND RESULTS: CHAIR NO.3 | | HAND AVERAGE | MY RESULT−AVERAGE | % | ACCUMULATED CHIPS WON/LOST | RANKING AFTER HAND |
| HAND NO. | MY RESULT | | | | | |
| 1 | 900 | 856 | 44 | 5.14% | 51 | 6 |
| 2 | 800 | 782 | 18 | 2.30% | 74 | 4 |
| 3 | 2100 | 2256 | −156 | −6.91% | 5 | 27 |

| OTHER RESULTS: CHAIR NO.3 | | PLAYER'S RESULT | PLAYER'S RESULT−AVERAGE | % | CHIPS WON/LOST |
|---|---|---|---|---|---|
| HAND NO. | PLAYER | | | | |
| 1 | P23 | 850 | −6 | −0.70% | −7 |
| 1 | P33 | 800 | −56 | −6.54% | −65 |
| 1 | P43 | 870 | 14 | 1.64% | 16 |
| 1 | P53 | 860 | 4 | 0.47% | 5 |
| 2 | P23 | 800 | | 2.30% | 23 |
| 2 | P33 | 800 | | 2.30% | 23 |

*FIG. 2*

SYSTEM AND METHOD FOR SKILL BASED GAMES OF CHANCE

FIELD OF THE INVENTION

The invention relates to the field of games of chance such as for example poker, and games of chance whose outcomes may depend on the skill of the players.

BACKGROUND OF THE INVENTION

Games of chance such as card games like poker and blackjack are widely played in various casino facilities and online, such as over the Internet or other computer networks. Typically the players in the tournament pay an entry fee, which allows them to sit at one of several tables where they compete against each other. At a table the players receive different cards, and a table scores its results independently of the results at other tables. The outcome of for example a poker game or tournament depends to a limited extent upon the skill of the players, but also depends significantly upon chance, or how good are the cards that the player receives.

Games of chance such as card games are regulated by laws in many jurisdictions. Some jurisdictions prohibit on-line games of chance for money.

SUMMARY OF THE INVENTION

Embodiments of the invention may include a random card generator and a computer, where the generator deals a first set of cards to two or more first positions at two or more tables, and the generator deals a second set of cards to two or more second positions at such tables, and the computer calculates the performance of card play at a first of such first positions and at second of such first positions. In some embodiments the computer may allocate winnings among the first positions in proportion to the performance of card play at a first of such first positions relative to the card play at all of such first positions. In some embodiments a communication system between first positions may enable a player at a first of such first positions to challenge a player at another first position. In some embodiments, the computer may calculate a performance of card play at a first of the first positions in a first hand of play and an aggregate of performances at such first of the first positions in several of hands of play.

In some embodiments the computer may allocate a number of chips to a first of the first positions, and the same number of chips to another first position. In some embodiments the computer may calculate a variance of a performance of card play at a first of the first positions from an average performance of card play among several first positions. In some embodiments the computer may simulate play of one or more positions. In some embodiments a card game may include poker or may include black jack. In some embodiments the computer may alternate the first position among several physical positions at a table.

In some embodiments the generator may deal a first set of cards to a second of the first positions at a time subsequent to the time that the generator deals a first set of cards to the first of the first positions. In some embodiments a number of chips allocated to a first position may be increased to match a blind in a round of play. In some embodiments the computer may simultaneously expose community cards to several tables. In some embodiments the computer may measure an interval between a start of a set of hands of cards and an end of a set of hands of cards. In some embodiments the computer may select a first position as dealer in a first set of cards and a second position as dealer in a second set of cards. In some embodiments the computer may calculate a performance of card play of a player at several positions at a table. In some embodiments the computer may grant a bonus hand to a player when the player participates in a pre-determined number of rounds of play. In some embodiments the system may include a recording device and a display, where the recording device is to record a round of card play of a first position, and a round of card play of a second position, and the display is to display the round of card play of the first position and the second position. In some embodiments the system may include a card holder to hold the cards dealt in several hands of play.

BRIEF DESCRIPTION OF THE DRAWINGS

The present invention will be understood and appreciated more fully from the following detailed description taken in conjunction with the drawings in which:

FIG. 2 is a table showing players' results from a hand of play and the calculation of such results in accordance with an embodiment of the invention;

DETAILED DESCRIPTION OF THE DRAWINGS

Figure 1:
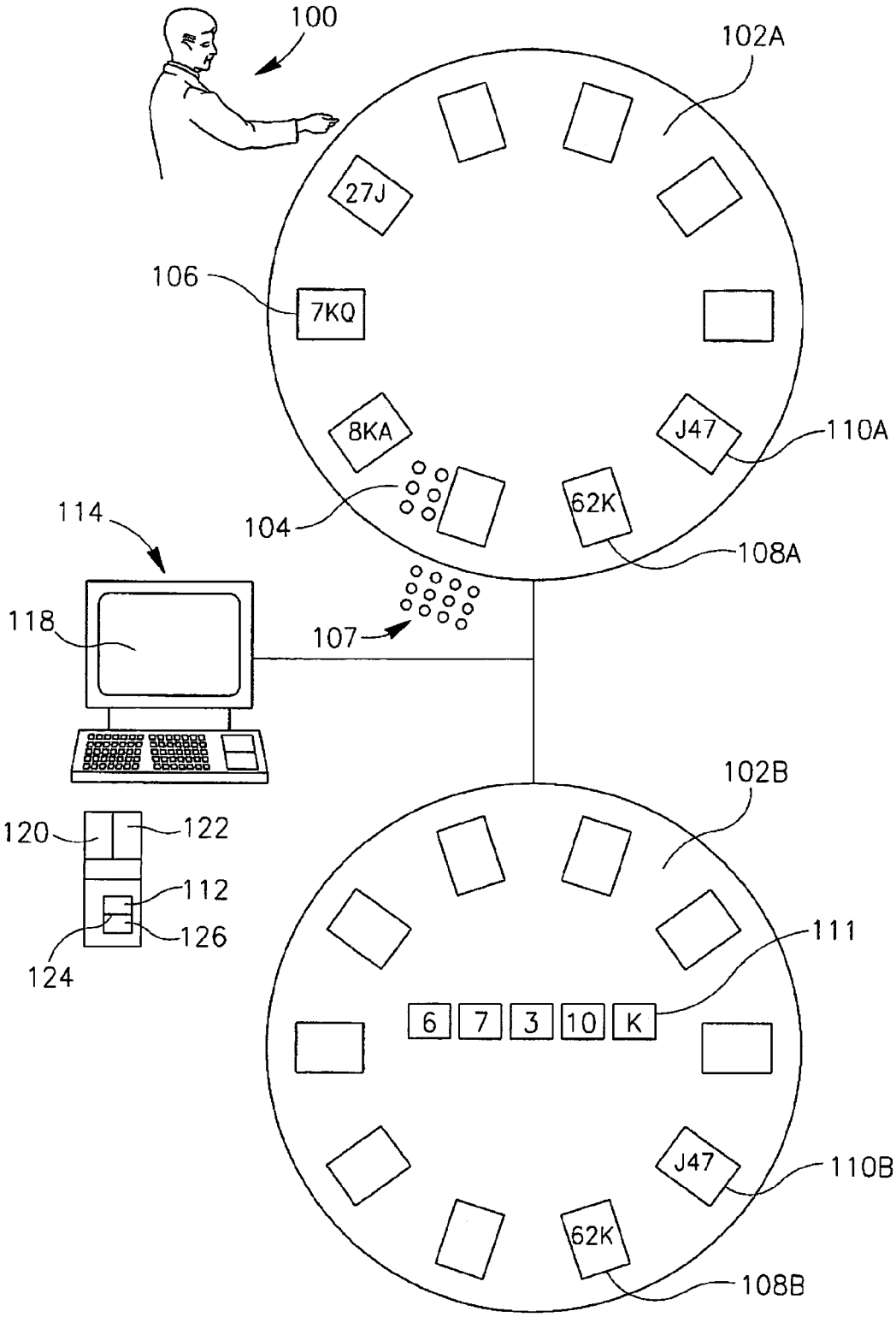
FIG. 1 is a schematic description of a skill-based game of chance in accordance with an embodiment of the invention.

In the following description, various aspects of the present invention will be described. For purposes of explanation, specific configurations and details are set forth in order to provide a thorough understanding of the present invention. However, it will also be apparent to one skilled in the art that the present invention may be practiced without the specific details presented herein. Furthermore, well-known features may be omitted or simplified in order not to obscure the present invention. Images described in this application as video may also include still images or other image or sensory data, including computer graphics. Calculations or tasks performed by a computer may also be performed manually.

Embodiments of the present invention describe a system and method for conducting games of chance whose outcome depends to a large extent or completely on the skill of the players. In some embodiments, players in for example a tournament may be seated at tables, with each player placed at a designated position at a table. A tournament may be held for example in a live setting, in a virtual or computerized setting that operates in real-time with all players playing at once over for example a computer network, in a time-delayed setting where players may play at different times, or in other suitable settings. Combinations of real and virtual, live, simultaneous or delayed tournaments are possible. For example, a table as used in this specification need not be a physical table, but may be a virtual table or other gathering area in real space or in a virtual space created or displayed over a computer network.

In some embodiments, at the start of a round or hand, decks of cards each shuffled in identical, random order may be presented to the tables in the tournament. In an exemplary embodiment of the invention more than one table or other group of players participates in a tournament. In a round of play, the same set of cards may be dealt to corresponding positions at the tables, such that for example, all players at position 1 at the tables or other groups may be dealt the same set of cards. In some embodiments the results of play, as may be measured by the results of the betting on a hand, that are achieved by a player at a designated position at a table are compared to results achieved by players at the same position at other tables. The relative difference between the results of a player at a particular position, and the results of other players at corresponding positions at other tables may be calculated. Such results may be converted into a value and aggregated by, for example, adding or subtracting from a player's accumulating chips or other measurers of a player's success such as money or points. The relative performance of a player in a particular position as compared with other players who were dealt identical sets of cards and who played against other players who were likewise dealt identical sets of cards may indicate the skill of such player, and may eliminate some or all of a chance component in a tournament of a game of chance.

Reference is made to FIG. 1, a schematic description of a computerized tournament of a skill-based game of chance in accordance with an embodiment of the invention. In some embodiments groups of players 100 such as for example ten players per group may assume real or virtual positions around a real or virtual table 102. For example, in some embodiments, one or more players may view a computer screen or display 118 upon which may be displayed representations of players at a group or table and the cards dealt to them in the course of a game of play. Other number of players 100 may be included in a group or at a table 102. Players 100 may be allocated on initial sum of accumulating chips 107 such as for example 2000 hand chips 104. Other numbers of accumulating chips 107 or other measures of success such as points or money may be used or no initial accumulating chips 107 may be allocated. A tournament may include many groups or tables 102 with the same or similar number of players 100 at such groups or tables 102. Cards 106 or visual representations of cards presented for example on a display or screen may be shuffled in a random order before the start of each hand or round of game play, and a set of cards 106 or visual or virtual representations of cards in the same random order may be distributed to the corresponding positions 108 at a table 102 for each hand. In some embodiments, cards 106 may be virtually shuffled and dealt by for example a random card generator 112, such as may be part of, connected to, or independent from a computer 114 system or computer network. For example, in some embodiments a random card generator 112 may randomly order a virtual deck of cards and distribute a number of cards or representations of cards, as is appropriate to the game being played, to the players 100 at a table 102 or virtual table. In some embodiments, computer 114 may be linked to a display 118 and representations of the cards 106 dealt to such player 100 may appear on a screen or display 118 visible by such player 100. In some embodiments a card generator 112 may produce cards 106 by for example printing physical cards 106 that may be distributed to players 100 at a physical table 102. Other ways of ordering and distributing cards 106 to players in accordance with the instructions of a card generator 112 are possible. In some embodiments, computer 114 may include a processor 120 such as for example a central processing unit, and a memory 122 such as for example, read only memory, random access memory or mass storage units such as a disk drive. In some embodiments, random card generator 112 may be included in computer 114 or may include a processor 120 and a memory 122.

Cards 106 may be dealt in the same order to the positions 108 around a table 102 so that the cards 106 dealt to a particular position 108 such as for example position 108A for table 102A are the same cards 106 as are dealt to position 108B at table 102B. Similarly, the set of cards 106 dealt to a second position 110A at table 102A may be the same set of cards 106 dealt to a second position 110B at table 102B. In some embodiments a position 108 at a table 102 may be designated as a first position 108 or second position 110 on an arbitrary or random basis beginning at any point at a table 102. Such first and second positions 110 may in some embodiments be not contiguous, sequentially numbered or otherwise methodically arranged. In some embodiments the physical position of for example a first position 108 at a first table 102 may be different from the physical position of a first position 108 at a second table 102.

In for example advance of each hand, players 100 may be allocated a number of hand chips 104 which may be used by the player 100 to wager only during the current hand. For example, a player 100 may be allocated 1000 hand chips 104 in advance of the start of a round or hand of play. The number of hand chips 104 allocated in a hand may be other than 1000. The number of hand chips 104 allocated to players 100 or positions may be increased, decreased or varied from one round to another. In some embodiments, hand chips 104 allocated to players 100 or positions in a round may be increased or decreased to match a blind that is used in such round.

A player 100 may be dealt the appropriate number of cards 106, with the same order of dealing maintained at the tables 102 or groups of play in for example a tournament, such that players 100 at the same positions 108 of different tables 102 are dealt the same cards 106. In some embodiments the community cards 111 dealt to a table 102 may be the same community cards 111 dealt to other tables 102. In some embodiments, the same community cards 111 may be dealt in the same order at the tables 102. In some embodiments, community cards 111 may be exposed at all tables 102 at the same time.

In one or more betting sessions in a round of play, players 100 may wager hand chips 104 thereby reducing the number of hand chips 104 held by such players 100 for such hand.

In some embodiments, a new set of hand chips 104 may be allocated to each player 100 for each new hand. In some embodiments, by allocating the same number of hand chips 104 to player 100 at the start of each hand, players 100 may compete on identical conditions. In some embodiments an increase in the number of hand chips 104 allocated for a round and the size of a blind may be a way to increase the rate at which players 100 are eliminated from a hand or tournament.

In some embodiments, a tournament may be divided into rounds, where a round includes one or more hands. In some embodiments, players 100 may move chairs or physical or designated positions 108 between rounds. Computer 114 may track the player 100 as he moves or alternates positions 108.

In some embodiments, a player 100 may receive a bonus for winning a hand in which he has bet all of the hand chips 104 that were allocated to him in the hand. A penalty may be levied against a player 100 who loses a hand where he had bet all of his hand chips 104.

In operation, random card generator 112 may deal a first set of cards 106 to the first position at the tables 102 that are for example participating in a tournament. Random card generator 112 may deal a second set of cards 106 to the second position at the tables 102. Other sets of cards 106 may be dealt to the particular positions at the tables 102. The performance of play, whether as a measure of the hand chips 104, accumulating chips 107, points scored or otherwise, for the first positions, second positions and other positions at the tables 102 may be recorded by for example computer 114. The performance by a player at the first position at a table 102 may be compared to the performance of play at the first positions of other tables 102 who were dealt the same set of cards.

Reference is made to FIG. 2, a table showing players' results from a hand of play and the calculation of such results or performance of play in accordance with an embodiment of the invention. In some embodiments, a calculation may be made of the hand chips held by a player, the points accrued by a player or other measure of performance (column 2) after each round or hand (column 1) at a given chair, in this case chair position 3. Such calculation may be compared with the average number of hand chips held by players at such chair (column 3) at the other tables following a round of play where each of such players in chair position 3 was dealt the same cards. The difference between the score of a player, the hand chips held by a player or some other performance measure of the player in a round of play and for example the average of the players in the chair position may be calculated (column 4). A percentage calculation (column 5) may be made of the variance or spread of the hand chips held by a particular player as against the average held by the other players in the same chair position of such player. In some embodiments a calculation of the percentage may be expressed by the following formula:

Player's results in %=(player result—hand average of players in same position)/(hand average).

Other suitable formulas or measures may be used, and a calculation of such formula may be performed by a computer or by hand.

In some embodiments, the percentage (positive or negative) of a player's variance from the average may be multiplied by the number of hand chips originally allocated to players in the hand, and such number may be used as the accumulating chips or points won or lost by a player in such hand, and as the number of accumulating chips to be increased or decreased from such player as a result of the hand (column 6). A ranking (column 7) of the player may be made among all players participating in the tournament. Such ranking may in some embodiments be based on the number of accumulating chips held by a player at the end of a hand or a group or set of hands. Other methods of calculating an increase or decrease in accumulating chips held by a player at the end of a round, or of calculating the standing of a player among other players may be used.

In some embodiments a player may be able to view a presentation of the results of a hand, his standing in the tournament and the number of hand chips and accumulating chips at any time. Other views are possible.

In some embodiments, a winner of a tournament may be the player at a given position of two or more tables who has the most or highest number of accumulating chips at the end of one or more sets of card play. Other methods of determining a winner are possible, and other measures of performance of card play are possible. In some embodiments a winner may receive a sum of money proportionate to the aggregate of his accumulating chips at the end of a tournament or hands of play relative to the total of accumulating chips of other players at the same position at other tables. For example if the total of accumulating chips of all players at a first position at several tables was 1000, a player who has 200 accumulating chips may receive 20% of the 1000 chips.

Figure 3:
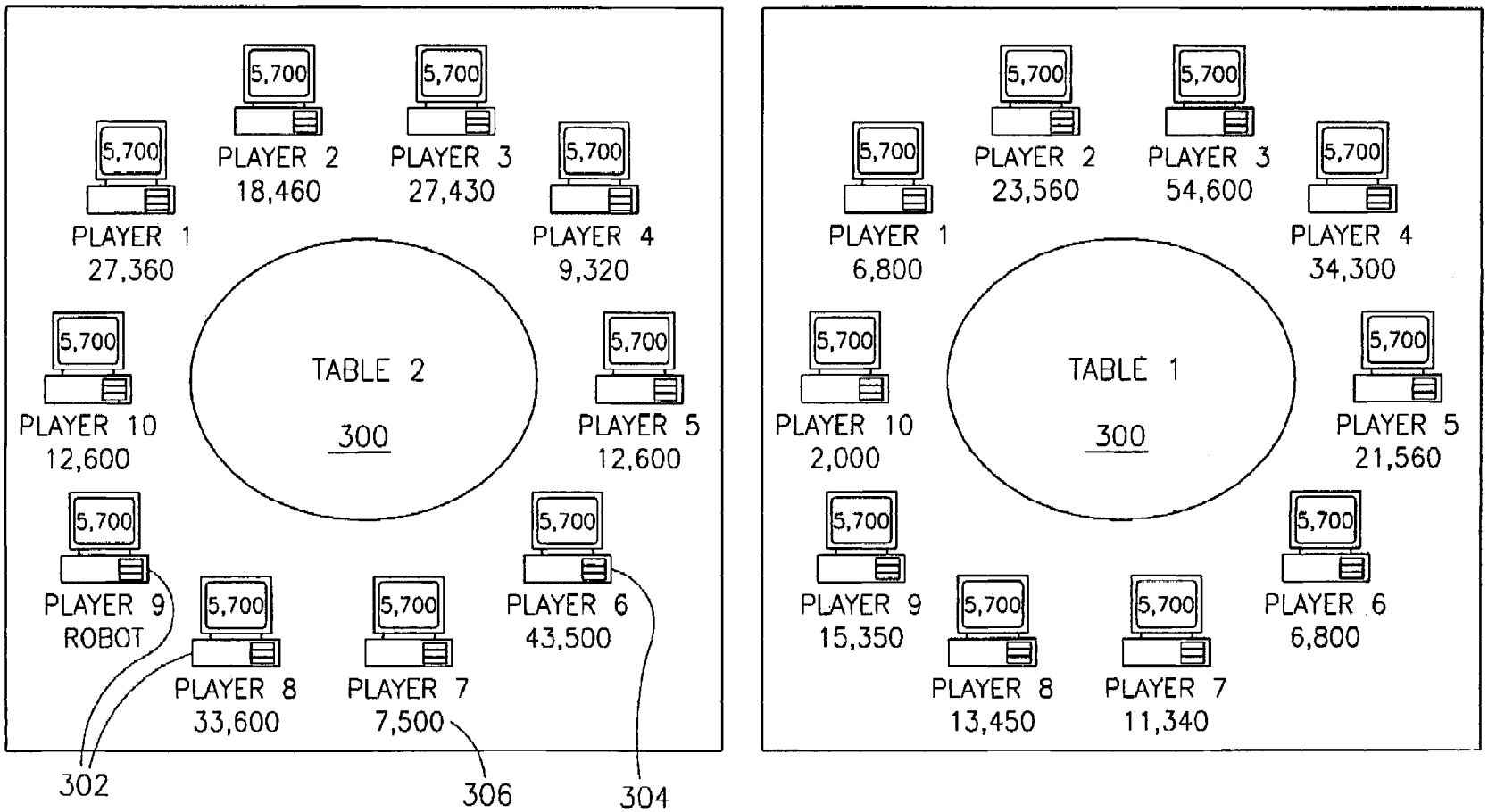
FIG. 3 is a schematic diagram of tables in a tournament after hands have been played in accordance with an embodiment of the invention.

Reference is made to FIG. 3, a schematic diagram of two playing tables 300 of a tournament after hands have been played in accordance with an embodiment of the invention. As shown in FIG. 3, a new hand is beginning, and a new sum of hand chips 302, in this case 5700 hand chips, may be allocated to players 304. Other number of hand chips 302 may be allocated.

In some embodiments, one or more players 304 may be eliminated from the tournament by losing all or some limit of accumulating chips 306. In some embodiments, an eliminated player 304 may be substituted by a robot or other automatic player in subsequent rounds, and a computer may simulate the play of an empty position at a table. Other methods of maintaining a full table 300 or of rearranging or optimizing players 304 among tables 300 to account for eliminated players may be used.

Figure 4:
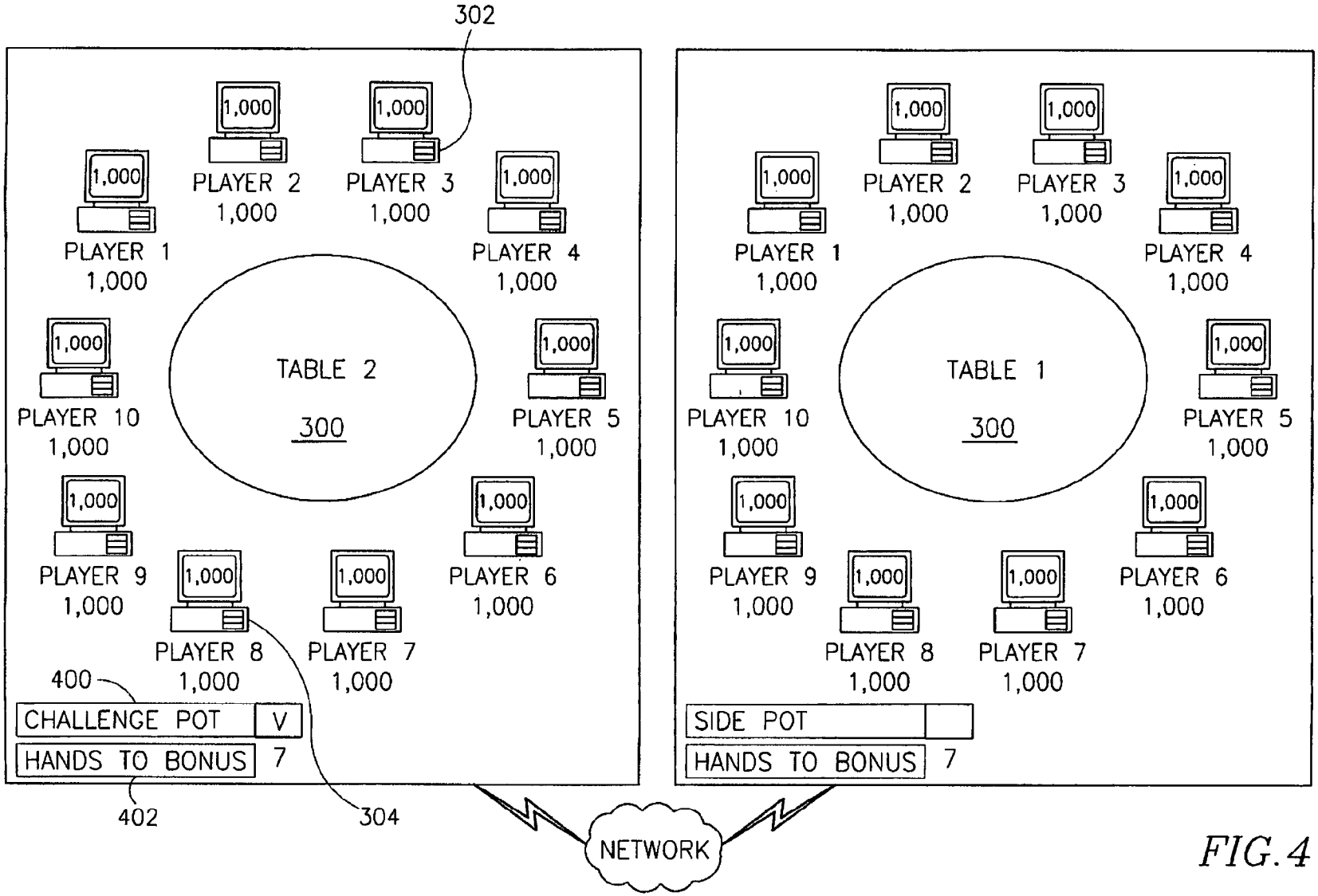
FIG. 4 is a schematic diagram of two tables with players holding a number of hand chips allocated for a hand of play, and a challenge pot in accordance with an embodiment of the invention.

Reference is made to FIG. 4, a schematic diagram of two playing tables 300 with players 304 holding a number of hand chips 302 allocated for a hand of play, and a side or challenge pot 400 in accordance with an embodiment of the invention. In advance of a hand, players 304 may be allocated a number of hand chips 302 which may be used by the player 304 to wager only during the current hand. For example, a player 304 may be allocated 1000 hand chips 302 in advance of the start of a round or hand of play. The player 304 at table 1 is holding the same hand as the player 304 on the same position at table 2. The relative performance of a player 304 is compared with other players 304 who was dealt identical hands of cards. In some embodiments, a challenge pot 400 function may be used to invite players to participate in a challenge pot. A player 304 may challenge other players 304 with identical cards to join a challenge pot 400 to compete against him, such that the players 304 participating in a challenge pot 400 may wager on their relative skill in playing the same hand of cards. A hands-to-bonus 402 function may reward a player 304 by giving him a free or bonus hand based on for example his participation in a pre-determined number of hands or rounds of play, or his performance in past hands.

In some embodiments each of the players at tables 300 pays a fixed fee to play the hand. The fees collected for example from all players 304 holding the same hand form a prize pool that may be distributed among the winners. In some embodiments there may be only one winner in each hand among the players 304, namely the player who has the largest number of chips left at the end of the hand, and player 304 may receive all the fees accumulated in the prize pool. In some embodiments there may be more than one winner, and the prize pool may be distributed proportionally to the number of chips left to each player 304 at the end of the hand. If more than one player 304 has an identical number of chips left, the prize pool may be distributed equally among the players who have the same number of chips. In some embodiments there may be more than one winner, and the prize pool may be distributed proportionally to the number of chips left to each player 304 at the end of the hand, but the player 304 with the lowest number of chips may not eligible for the prize, and the other players' 304 relative number of chips may be calculated after subtracting the number of chips of the lowest ranking player. Other methods of dividing chips or establishing a winner are possible.

In some embodiments tournaments may be held for various games of poker such as Texas hold 'em or other variations of poker. Other games such as blackjack or games that include one or more elements of chance such as for example a roll of dice such as in backgammon may be used in embodiments of the invention.

Figure 5:
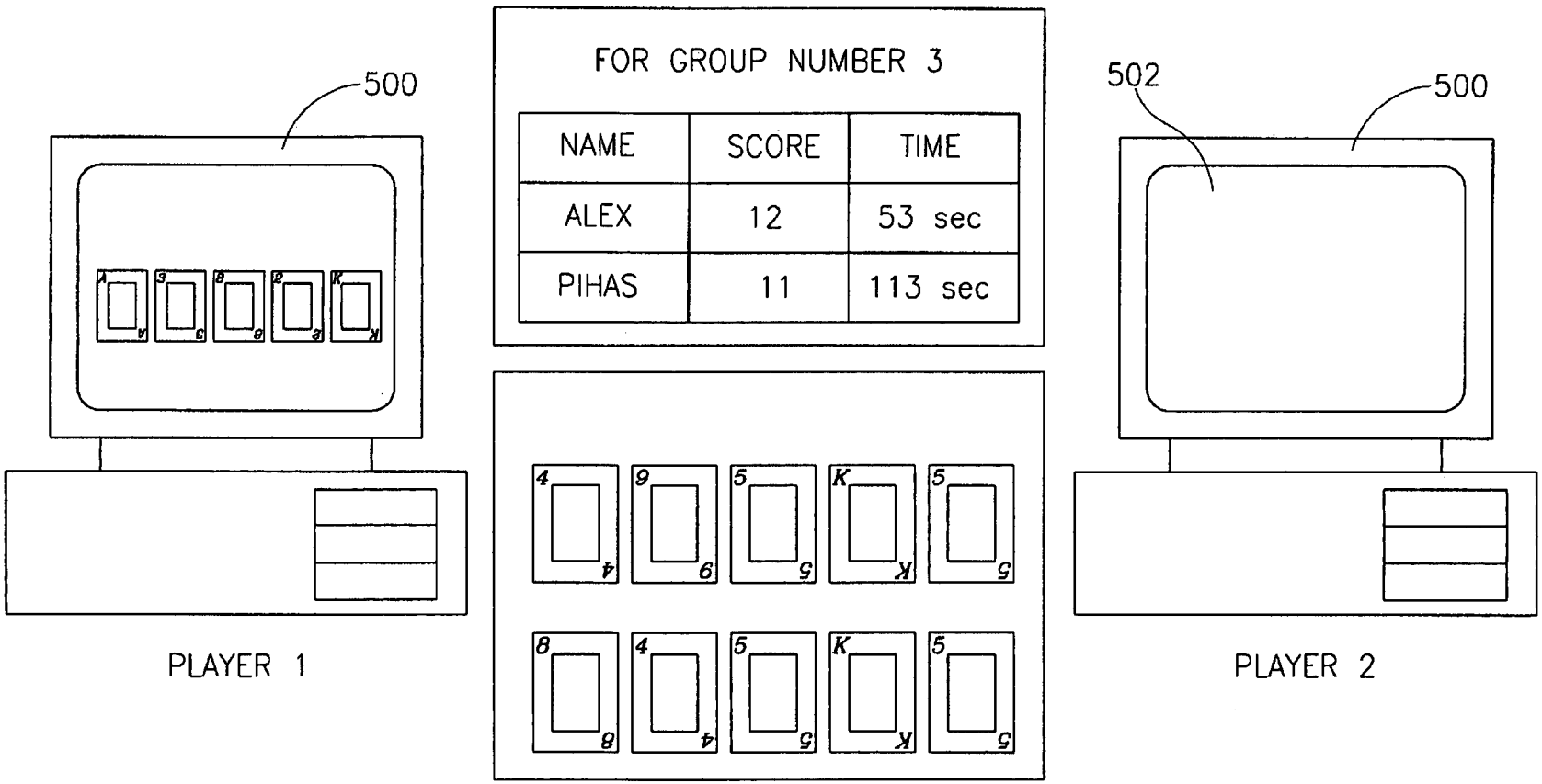
FIG. 5 is a diagram of a video poker machine, in accordance with an embodiment of the present invention.

In some embodiments, video poker tournaments may be held among players who may play at the same or at different times. Reference is made to FIG. 5, a diagram of two video or computerized poker machines 500 prior to the start of a first hand in accordance with an embodiment of the present invention. A player, such as for example Alex (other names may be used) may pay a sum such as a dollar to play a pre-determined number of hands such as for example 10 hands. Player Alex may be dealt a hand of cards. Player Alex may be allowed to hold or exchange the cards that are dealt to him in accordance with the rules of the particular game he is playing, and the decisions that player Alex takes to improve his hand.

The results of player Alex in one or more rounds played may be recorded in connection with the player's name or ID in for example a computer or other data storage system linked to the video poker machine. A next or subsequent player, for example Pinhas, who may play on the same video poker machine at for example a time after the first player, or at the same time on a different machine linked to a network, may be dealt the same cards in all of the hands as were played by player Alex. Player Pinhas may hold or exchange different cards than player Alex, to improve his hand. The score of such next player Pinhas may be calculated from for example all of the hands played, and such score may be compared to the score of player Alex to determine which player has the higher score. The results of play of the players may be displayed on a display 502. In some embodiments the time or time interval taken by a player from the start of a round until the end of a round may be recorded with the player's score, and, in the event of a tie among players, the player with the lower time may win. A player with the highest score from all of the hands among the players who played such hands may win an amount of money or points that may in some embodiments be based on the amount originally paid by such player. Other players may also play a set of hands having the same cards as were played by Alex and Pinhas, and the relative performance between all players who played the same hands will be used as a key to distribute the prizes.

In some embodiments, a recording device such as a computer may record the play of for example one or more rounds. The recorded play may be played back on for example a display, and for example a player may view the results of the hands that he played and the results of other players as they played those same hands.

In some embodiments, a computer may be used to track and order the cards dealt in a live tournament, such that in a live setting, players sitting in a corresponding chairs are dealt the same cards and identically ordered but randomly shuffled cards are distributed to each table. In some embodiments, community cards may be exposed to all tables at the same time. Other security measures may be taken at live tournaments so that players at different tables do not communicate with each other. For example, a first position may be designated at varying physical points on various tables, such that a player at a first table may not know which of the players at a second table has been dealt the same cards.

In some embodiments, in live tournaments, a specially designed card holder may be used to hold the cards of each of the hands and the community cards, in separate pockets, preserving the distribution of the cards for re-use at other tables.

In some embodiments, a computer may be used to track and order the cards dealt in an online competition, such that hands at different tables are rotated and the dealer is changed from one position to another, such that a first position may be designated as a dealer in a first round of play, and another position may be designated as a dealer in a second round of play.

In some embodiments a central server may manage the cards, scoring, winnings, and process of a tournament over a network such as for example for Internet or a computer network. The server or a computer may randomly shuffle cards, distribute the cards to the table, arrange the players, provide communication security, insert a robot player where necessary, calculate winnings and perform other functions. The computer may simultaneously deal cards to corresponding positions at several tables and expose community cards to such tables. The computer may include a server, one or more displays and input/output devices that may be used by a player to view cards and interact with the game, a communication system to link the server and the computers, a payment system and other devices, such as for example a database computer. A player may interact with for example a personal computer or other electronic device, and a tournament may be managed by a web server that is in communication with such electronic devices.

Embodiments of the invention may be included in one or more instructions that may be stored in a storage medium. Such instructions when executed may produce or result in an embodiment of the invention.

It will be appreciated by persons skilled in the art that embodiments of the invention are not limited by what has been particularly shown and described hereinabove. Rather the scope of at least one embodiment of the invention is defined by the claims below.

I claim:

1. A method of conducting a tournament based on a card game, comprising:

arranging players at a plurality of tables such that at least two players are seated at each table, and whereas each player occupies a numbered seat at a table;

assigning the players to groups, wherein each separate group comprises all of the players seated at a particular numbered seat;

dealing a set of cards to the players, wherein players in different groups receive different cards, and wherein all of the players within same group receive the same cards;

allowing the players to play a hand of a card game using the cards they have been dealt, wherein each of the players may place bets during the hand, and wherein all players are limited to betting the same maximum amount during each hand, wherein during play of the hand, a player may make a separate challenge bet with his hand chips, wherein the separate challenge bet is extended only to other players within the same group.

2. The method of claim 1, wherein if a first player within a group makes the separate challenge bet, and one or more other players within the group accept the separate challenge bet, then the total amount of all the separate challenge bets is used to establish a challenge pot.

3. The method of claim 2, wherein at the end of the hand of play, the challenge pot is awarded to the player, among all of the players that accepted the separate challenge bet, who achieved the best result during that hand.

4. The method of claim 1, further comprising:

recording the results of the hand of the card game;

repeating the dealing, allowing and recording steps until a predetermined condition is satisfied;

comparing the recorded results for all players in one group to each other and ranking the players within the group; and repeating the comparing step for other groups of players until the players in all groups have been ranked with respect to each other.

5. The method of claim 4, wherein the step of repeating the dealing, allowing and recording steps until a predetermined condition is satisfied comprises repeating the dealing, allowing and recording steps until a predetermined number of hands have been played.

6. The method of claim 4, wherein the comparing step comprises ranking all the players within a single group based on the amount of hand chips won or lost by the players within the group.

7. The method of claim 4, wherein during the recording step, the amount of hand chips won or lost by each player during a first hand are recorded to establish a total for each player, and wherein the amount of hand chips won or lost by each player during subsequent hands is added to or subtracted from each player's respective total.

8. The method of claim 4, further comprising awarding prize money to some players based on the rankings determined in the comparing step.

9. The method of claim 1, wherein the arranging step comprises arranging players at a plurality of tables wherein the tables are located different physical locations.

10. The method of claim 1, wherein the card game comprises Texas Holdem poker, and wherein during the step of allowing the players to play a hand of a card game, at each of the plurality of tables, additional cards are dealt from the pre-ordered deck as common table cards that all players can use during the hand, and wherein the additional common table cards are the same at each of the tables.

11. The method of claim 1, wherein the card game comprises Omaha Poker, and wherein during the step of allowing the players to play a hand of a card game, at each of the plurality of tables, additional cards are dealt from the pre-ordered deck as common table cards that all players can use during the hand, and wherein the additional common table cards are the same at each of the tables.

12. The method of claim 1, wherein the players play from client computers that are linked to a host computer, and wherein the dealing step comprises sending signals from the host computer to the client computers to indicate which cards are being dealt to the players.

13. The method of claim 12, wherein during the step of playing a hand, signals are exchanged between the client computers and the host computer to indicate betting, folding and other actions being made by the players.

14. The method of claim 1, wherein the card game comprises draw poker.

15. The method of claim 14, wherein during the playing step, at each of the plurality of tables, additional draw cards are dealt to the players from respective pre-ordered set of cards reserved for each player such that all players within the same group receive the same draw cards.

16. The method of claim 1, wherein the card game comprises blackjack.

17. The method of claim 16, wherein during the playing step, at each of the plurality of tables, additional draw cards are dealt to the players from respective pre-ordered sets of draw cards reserved for each player such that all players within the same group receive the same draw cards.

18. The method of claim 1, further comprising recording the results of the hand of the card game, wherein during the recording step, a bonus is added to a player's results if the player has bet all of his hand chips, and won the hand.

19. The method of claim 1, further comprising recording the results of the hand of the card game, wherein during the recording step, a penalty is subtracted from a player's results if the player has bet all of his hand chips, and lost the hand.

20. The method of claim 1, further comprising receiving the same playing fee from each player before play begins.

21. The method of claim 20, further comprising using all or a portion of the total playing fees collected from the players to form a prize pool.

22. The method of claim 21, further comprising:

recording the results of the hand of the card game;

repeating the dealing, allowing and recording steps until a predetermined condition is satisfied, wherein during each separate hand of cards that is played, all players start with the same amount of hand chips;

comparing for recorded results for all players in one group to each other and ranking the players within the group; and repeating the comparing step for other groups of players until the players in all groups have been ranked with respect to each other.

23. The method of claim 22, wherein during the recording step, the amount of hand chips won or lost by each player during a first hand are recorded to establish a separate total for each player, and wherein the amount of hand chips won or lost by each player during subsequent hands is added to or subtracted from each player's respective total.

24. The method of claim 23, further comprising distributing the prize pool between multiple players based on the rankings determined in the comparing step.

25. The method of claim 24, wherein the same portion of the prize pool is distributed to each the highest ranked player in each of the groups.

26. The method of claim 24, wherein the players within the different groups that receive the same ranking are awarded the same portion of the prize pool.

27. The method of claim 1, further comprising:

recording the results of the hand of the card game;

repeating the dealing, allowing and recording steps until a predetermined condition is satisfied; and playing back, on demand, a record of the cards played and the results achieved by each of the players in each of the hands played.

28. The method of claim 27, wherein during the playing back step, a user can review each of the cards played and the bets made in a step-wise fashion.

29. The method of claim 1, further comprising:

recording the results of the hand of the card game;

repeating the dealing, allowing and recording steps until a predetermined condition is satisfied, wherein during each separate hand of cards that is played, all players start with the same amount of hand chips;

comparing the recorded results for all players in one group to each other and ranking the players within the group; and repeating the comparing step for other groups of players until the players in all groups have been ranked with respect to each other.

30. A method of conducting a tournament based on a card game, comprising:

arranging players at a plurality of tables such that at least two players are seated at each table, and wherein each player occupies a numbered seat at a table;

assigning the players to groups, wherein each separate group comprises all of the players seated at a particular numbered seat;

dealing a set of cards to the players, wherein players in different groups receive different cards, and wherein all of the players within same group receive the same cards;

allowing the players to play a hand of a card game using the cards they have been dealt, wherein during play of the hand, a player may make a separate challenge bet, wherein the separate challenge bet is extended only to other players within the same group.

31. The method of claim 30, wherein if a first player within a group makes a separate challenge bet, and one or more other players within the group accept the separate challenge bet, then the total amount of all the separate challenge bets is used to establish a challenge pot.

32. The method of claim 31, wherein at the end of the hand of play, the challenge pot is awarded to the player, among all of the players that accepted the separate challenge bet, who achieved the best result during that hand.

* * * * *